US005423169A

United States Patent [19]

Hubert

[11] Patent Number: 5,423,169

[45] Date of Patent: Jun. 13, 1995

[54] PROCESS TO TEST THE MONITORING FUNCTION OF AN ELECTRONIC SENSOR AT THE WORK STATION OF A TEXTILE MACHINE AND DEVICE TO CARRY OUT THE PROCESS

[75] Inventor: Lochbronner Hubert, Lenting, Germany

[73] Assignee: Rieter Ingolstadt Spinneremaschinenbau AG, Ingolstadt, Germany

[21] Appl. No.: 45,644

[22] Filed: Apr. 9, 1993

[30] Foreign Application Priority Data

Apr. 16, 1992 [DE] Germany ..... 42 12 695.9

[51] Int. Cl.[6] ..... D01H 13/76; D01H 9/10

[52] U.S. Cl. ..... 57/264; 57/265; 57/269

[58] Field of Search ..... 57/264, 265, 261, 262, 57/263, 269, 279

[56] References Cited

U.S. PATENT DOCUMENTS

| | | | |
|---|---|---|---|
| 4,047,371 | 9/1977 | Stahlecker | 57/264 |
| 4,823,544 | 4/1989 | Igel | 57/265 |
| 5,159,804 | 11/1992 | Schippers et al. | 57/263 X |
| 5,235,800 | 8/1993 | Slavik et al. | 57/263 X |

FOREIGN PATENT DOCUMENTS

| | | | |
|---|---|---|---|
| 47723 | 3/1982 | European Pat. Off. | 57/261 |
| 487949 | 6/1992 | European Pat. Off. | 57/264 |
| 3900088A1 | 7/1990 | Germany . | |
| 3930450 | 3/1991 | Germany | 57/265 |

*Primary Examiner*—Daniel P. Stodola
*Assistant Examiner*—William Stryjewski
*Attorney, Agent, or Firm*—Dority & Manning

[57] ABSTRACT

A process to test the monitoring function of an electronic sensor at the work station of a textile machine in order to avoid wrong decisions by the control unit of the work station. The sensors are tested during operation. For a brief time span a second sensor of the same type is located at the same time within the operating range of the sensor of the working station so that its function overlaps in time with that of the sensor of the work station. During the time of overlap the logical levels of the two sensors are detected, compared with each other and classified as result of the test.

8 Claims, 2 Drawing Sheets

PROCESS TO TEST THE MONITORING FUNCTION OF AN ELECTRONIC SENSOR AT THE WORK STATION OF A TEXTILE MACHINE AND DEVICE TO CARRY OUT THE PROCESS

BACKGROUND OF THE INVENTION

The instant invention relates to automatic testing of the monitoring function of an electronic sensor at a work station of a textile machine in which spun yarn is wound up on cross-wound bobbins. Such textile machines may be ring spinning machines, rotor spinning machines, winding machines or twisting machines.

Electronic sensors with different monitoring/functions are used at each work station of the various textile machines. These monitoring functions may consist of:

Monitoring the presence of the yarn produced

Monitoring the limit value for reaching a desired bobbin diameter in a cross-wound bobbin.

The electronic sensors function without physical contact with the monitored object. The work stations of a textile machine define a yarn course. The yarn course goes to a winding station where a cross-wound bobbin is produced. The different work stations of the textile machine are equipped with identical sensors. The sensors used to monitor the presence of the produced yarn monitor the state of yarn presence or yarn absence and form a signal for the corresponding state.

The sensor monitoring the limit values for an attained bobbin diameter detects the state when the bobbin diameter is still too small and the state when the bobbin diameter has attained the predetermined limit value. The sensor emits a corresponding signal for each state. It is characteristic for both sensors to work with binary signals. This indication of state is achieved electronically through a logical level display.

The sensors of a work station transmit their signals to a control unit. The control unit receives and processes the signals of the sensors of several work stations, i.e. the stations in one machine section. If the sensors detect a state (as described above), they signal it by means of a binary signal to the control unit of the machine section. On the basis of this signal the machine section may cause:

the work station to stop its activity in case of a yarn breakage, the work station to be stopped when a desired bobbin diameter has been attained and a bobbin replacement is to be initiated.

This will be explained in greater detail below through the example of a sensor used to monitor the presence of the produced yarn. A sensor of this type is a yarn monitoring system. The yarn monitoring system must monitor the course of the yarn and/or the yarn quality in any case. The yarn monitoring system recognizes two logical levels in monitoring the course of the yarn:

"Yarn present" or

"No yarn present"

Developments in electronics have replaced the mechanical yarn monitor as the latter was often subject to damage due to operator errors. With the electronic yarn monitoring system it was possible to integrate yarn quality monitoring in addition to the function consisting of monitoring the presence of the yarn into one single component.

Quality monitoring necessarily requires the yarn-presence monitoring function, i.e. if no presence of yarn is signalled, the quality monitoring feature need not operate. In a yarn monitoring system incorporating both functions, it is possible to draw conclusions concerning quality monitoring by testing the yarn-presence monitoring function. Since the quality monitoring function depends primarily on the function of the yarn-presence monitor, an indication concerning the function of the yarn-presence monitor is sufficient in order to finally evaluate the function of the yarn monitoring system. Testing the yarn monitoring system is understood to mean testing its yarn-presence monitoring function. Spinning machines having no yarn monitoring system are however provided with at least a yarn-presence monitor and can also be included in the following discussion. The following discussion similarly applies also to an electronic sensor used to monitor the limit value of the bobbin diameter of the cross-wound bobbin to be produced.

It may occur that the function of the electronic yarn monitoring system is interrupted. Such interruptions can be provoked in electronic yarn monitoring systems operating on capacitive as well as according to optical principles.

Dirt may cause an erroneous level to be formed, i.e. the presence of a yarn may be signalled even though none is present, or is not even recognized as such. This problem may occur as a result of electrostatic supercharging of the yarn monitoring system. Such electrostatic supercharges may be produced due to the friction caused by the running yarn between yarn and yarn monitoring system, for example at the end points of the traversing movement. This causes flying fibers to be deposited and to be spread in the running direction of the yarn so that they may simulate the course of a yarn. This may also cause an erroneous level indication. Defects in the electronic system of the yarn monitoring system due to age, temperature influences, etc. are also possible.

An interference with the functions of the yarn monitoring system may have serious consequences, e.g. damage to or destruction of operating elements. The possibility of controlling the functioning of the yarn monitoring system is therefore needed.

The yarn monitoring system at the spinning station of an open-end spinning machine controls fiber feed after piecing as a function of the operating conditions which occur (i.e. depending on whether the piecing process has been successful or not). If fiber feed is started up as a result of an erroneous level indication of the yarn monitoring system, even though no yarn draw-off takes place, this leads to new production stoppages and to damage inflicted upon the spinning elements of the spinning station.

DE-OS 39 00 088 describes the monitoring of the functions of electronic yarn-presence monitors, whereby the latter detect yarn breakage. The known solution is based on the principle that a verification is carried out before each bobbin replacement to ascertain that all those yarn-presence monitors having signalled no yarn breakage before bobbin replacement do signal yarn breakage during the bobbin replacement. A yarn monitor which did not signal any yarn breakage before the bobbin replacement must signal a yarn breakage during bobbin replacement, otherwise it is considered to be defective. The known system merely checks whether the sensor (yarn-presence monitor) indicates a change in the output signal (change of the logical level). It is a disadvantage that even after a level change it is impossible to recognize whether the indicated state (level) is correct, so that the functional test does not provide sufficient certainty.

OBJECTS AND SUMMARY OF THE INVENTION

It is a principal object of the instant invention to further improve the testing of the monitoring function of an electronic sensor, so that greater certainty in operation of the machine may be achieved without any additional outlay for such devices.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

In a textile machine an automatic travelling carriage patrols on a rail system along the work stations. The automatic travelling carriage assumes the task of piecing fiber material after a yarn breakage or to carry out a bobbin replacement. In these instances, or during other maintenance and verification tasks, the automatic travelling carriage stands before the effected work station. Based on this positioning of the automatic travelling carriage before the spinning station, it can be assumed that at least one or both sensors, i.e. the sensor monitoring the presence of yarn as well as the sensor monitoring the limit value with respect to the attainment of a desired bobbin diameter, are operating. The sensor is the device which monitors the above-mentioned states. The testing of the monitoring function can therefore be carried out during operation.

It is a characteristic of the instant invention that a second sensor of the same type is introduced into the work area of the electronic sensor to be checked, so that the functions of both sensors overlap briefly and so that the indicated logical levels of both sensors are detected, evaluated, and classified as a result of the test during the period of overlap of the functions. The sensors transmit their logical level to the control unit of the machine section. The control unit of the machine section is equipped with a computer which initiates a signal when a sensor function outage is detected in order to stop production at the work station. The test is thereby completed and the sensor which was introduced in addition is withdrawn from the work area of the former. The only outlay in equipment required is the second sensor of the same type which must be present so that the test of the monitoring function may be carried out. The second sensor may be installed in the automatic travelling carriage on a movable presentation device so that when the automatic travelling carriage is positioned before the work station said second sensor may be introduced briefly into the work area of the corresponding sensor of the work station. The sensors discussed are provided with a signal connection going to the control unit of the machine section where a computer is installed. The machine section in turn is provided with a connection to the machine center of the textile machine.

The invention has the advantage that improved testing of the monitoring function of an electronic sensor is made possible with little outlay in equipment. The invention is characterized by the features contained in the first claim.

An embodiment of the invention is shown in the drawing and is described below in further detail. The drawings constitute a part of this specification and serve to explain the principles of the invention.

DESCRIPTION OF THE PREFERRED EMBODIMENTS

Figures 1A, 1B:
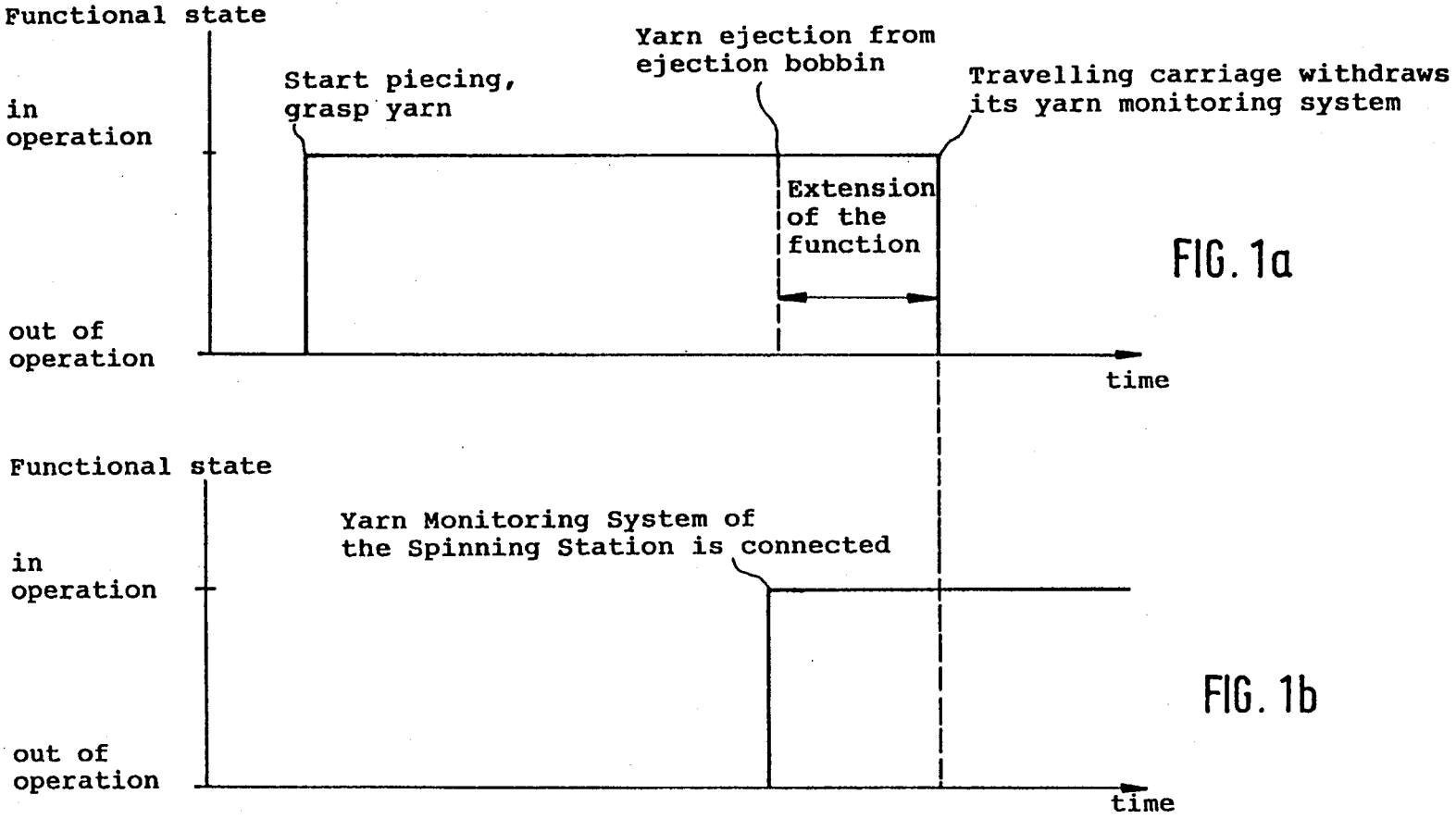
FIG. 1*a* shows the functional state of the yarn monitoring system of the automatic travelling carriage.
FIG. 1*b* shows the functional state of the yarn monitoring system of the spinning station.

Reference now will be made in detail to the presently preferred embodiments of the invention, one or more examples of which are illustrated in the drawings. Each example is provided by way of explanation of the invention, not limitation of the invention.

Figure 2:
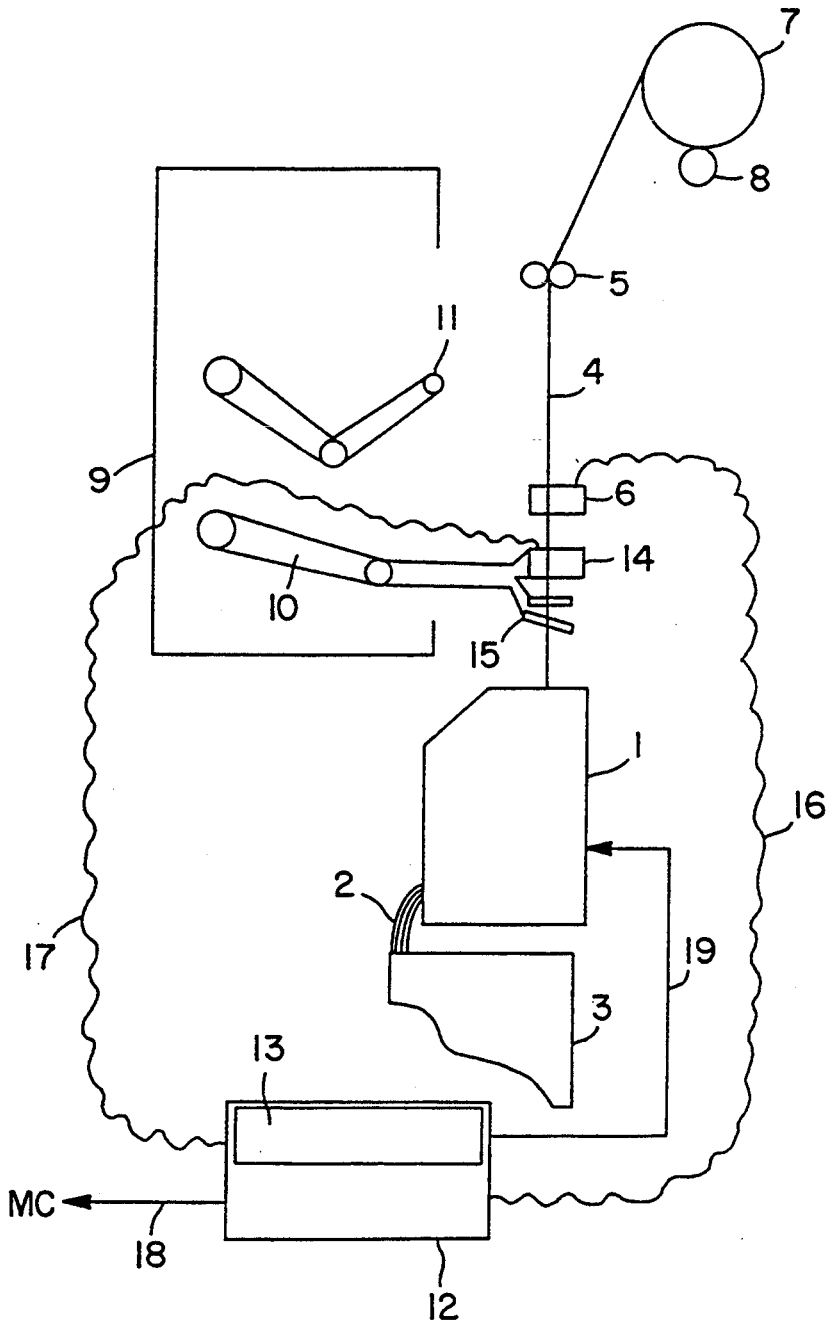
FIG. 2 is a diagrammatic view of an embodiment of apparatus for practicing the claimed invention and particularly illustrates a travelling service carriage at a work station.

An apparatus for practicing the present invention is generally illustrated in FIG. 2. FIG. 2 is a diagrammatic representation of an automatic travelling service carriage 9 and spinning station 1 of an open-end spinning machine. FIG. 2 illustrates the state of the machine after yarn 4 has been thrown off from a movable throw-off spindle 11. Carriage 9 also includes a moveable presentation device or arm 10. The drive for arm 10 is not shown. Arm 10 includes a yarn monitoring system 14 and a grasper 15. Spinning station 1 receives a sliver 2 from a sliver can 3 for processing into a yarn 4. A yarn monitoring system 6, draw-off rollers 5, yarn bobbin 7, and winding drum 8 are also provided on the machine. Yarn monitoring systems 6 and 14 include electrical connections 16 and 17 to a control unit 12. Control unit 12 can be arranged in the spinning section control center, in the machine control center, or in the automatic travelling carriage computer 13. Output 18 from control unit 12 is transmitted to a machine control unit MC another output 19 from control unit 12 is transmitted to spinning station 1, and in particular to the drive for fiber feed.

A spinning station of an open-end spinning machine signals a yarn breakage, for example. As is well known in the art, the automatic travelling carriage stops before the spinning station concerned and carries out piecing. The automatic travelling carriage contains among other things the device presenting the yarn end to the rotor. The presentation device is in this instance essentially the grasper of the yarn end. The grasper has grasped the piecing end of the yarn from the bobbin. The yarn monitoring system of the automatic travelling carriage is always located in immediate proximity of the grasper and thus the yarn monitoring system of the automatic travelling carriage is switched on at the moment when the yarn end is grasped and records the course of the yarn, i.e. the level signals "yarn present". Only when this condition is met does the testing process begin. FIG. 1*a* shows this state.

Although the geometry of the course of the yarn of the yarn monitoring system is different in the automatic travelling carriage, it was found that during the piecing process the yarn monitoring system of the automatic travelling carriage is located for a brief moment within the course of the yarn monitoring system of the spinning station. It was found furthermore that the yarn monitoring system of the automatic travelling carriage should be extended towards the end of its original monitoring task by a functional period up to several seconds, so that at the moment when the yarn is transferred to the rotor the functional times of the two yarn monitoring systems overlap, i.e. so that the yarn is for a brief time still under the supervision of the yarn monitoring system of the automatic travelling carriage and is at the same time again under the supervision of the yarn monitoring system of the spinning station. This is also the period during which the course of the yarn is engaged with the yarn monitoring system of the automatic travelling carriage as well as with the yarn monitoring system of the spinning station. During this brief, additionally provided overlap period (only during the piecing process), the yarn monitoring system at the spinning station is tested.

As is shown, the duration of the function of the yarn monitoring system of the automatic travelling carriage is necessarily extended after ejection of the back-fed yarn end from the ejection bobbin which belongs in a known manner to the automatic travelling carriage. This is a characteristic of the invention. FIG. 1*b* shows by comparison the yarn monitoring system of the spinning station. As the yarn is thrown off from the throw-off bobbin, yarn monitoring is switched over to the spinning station. By comparing Figs. 1*a* and 1*b* the overlap of the periods of functioning becomes apparent. During this period of overlap the yarn monitoring system of the spinning station is tested during the piecing process. This is another essential characteristic of the invention. During the time of overlap of the functioning periods of the two yarn monitoring systems their signals, which represent the logical levels, are transmitted to the control unit of the machine section (section controller), or to the machine center or to the automatic travelling carriage and are evaluated. The test consists in finding the momentary level of both yarn monitoring systems and in comparing them and in classifying the result.

The two levels are thus the results of functional units which are independent of each other so that the correctness of the transmitted level of the yarn monitoring system of the spinning station, and thereby the correctness of the indicated technological state of operation can be obtained with certainty through the logical comparison between the two levels. The only logical levels considered are "yarn present" or "no yarn present". The results of the comparison lead to a classification. The following matrix states results from the comparison between levels:

| Logic Level | | |
|---|---|---|
| Yarn monitoring system of the spinning station | Yarn monitoring system of the automatic travelling carriage | Classification of the technological state |
| 1. Yarn present | Yarn present | Piecing successful |
| 2. No yarn present | No yarn present | Error state I: yarn breakage in the automatic travelling carriage, repeat piecing |
| 3. No yarn present | Yarn present | Error state II: Yarn monitoring system of the spinning station defective, error due to missing function |
| 4. Yarn present | No yarn present | Error state III: Yarn monitoring system of spinning station defective, error due to wrong logical level |

The error state I is the state in which the yarn broke during the piecing process in the presenting device of the automatic travelling carriage. The piecing process is repeated.

Error state II initiates a switch-over to malfunction state, i.e. the spinning station is stopped because a functional error of the yarn monitoring system exists due to a missing level change at the yarn monitoring system of the spinning station, e.g. as a result of an electrical defect or dirt on the optically active surfaces of a yarn monitoring system operating on an optical principle.

With the classification of error state III the section controller (machine section) recognizes that the yarn monitoring system of the spinning station is defective, even though a level change was possible. This state is displayed to the operating personnel and the spinning station is stopped. The critical situation of the fiber feed receiving the delivery signal even though the piecing process was not successful is thus avoided. This is a decisive advantage of this invention.

This comparison of levels is carried out in the brief time period when the functions of the two yarn monitoring systems overlap. Even before the automatic travelling carriage withdraws its presentation unit before piecing, the result of the level comparison is available and the control unit of the spinning section cannot trigger an erroneous action as described in the beginning.

It is a great advantage to use the yarn monitoring system of the automatic travelling carriage during the piecing process in order to test the yarn monitoring system of the spinning station. Thus, an additional installation of a yarn monitoring system in the automatic travelling carriage for the purpose of testing the yarn monitoring system of the work station can be omitted.

The invention can also be used with spinning machines having a stripped-down yarn monitoring system, i.e. one which only features the yarn-presence monitor.

It will be apparent to those skilled in the art that various modifications and variations can be made in the present invention without departing from the scope or spirit of the invention. It is intended that the present invention cover such modifications and variations.

I claim:

1. A method for testing the monitoring functions of a work station sensor of a textile machine, the sensor being operational over a predetermined period of time defining a working range of the sensor, the sensor indicating certain conditions within its working range said method comprising the steps of:

drawing a yarn in a running yarn course past the work station sensor causing the work station sensor to generate an indicated condition of the yarn course;

recording the indicated conditions of the work station sensor over its working range;

summoning a travelling carriage to the textile machine work station and operably disposing a second sensor on the travelling service carriage in the running path of the yarn, and extending the working range of either of the second sensor or the work station sensor so that an overlap exists in the working of the work station sensor and travelling service carriage sensor;

recording the indicated conditions of the travelling service carriage sensor over at least the portion of its working range which overlaps the working range of the work station sensor; and comparing the indicated conditions of the work station sensor and travelling service carriage sensor in their overlapping working range to determine error conditions in the work station sensor; and repairing the work station sensor if necessary to eliminate any error conditions,

2. The method as in claim 1, wherein said method is used to test an electronic yarn monitoring system at a spinning station of the textile machine.

3. The method as in claim 2, further comprising generating an error signal when the indicated condition of the spinning station sensor indicates that a yarn is present and the indicated condition of the travelling service carriage indicates that no yarn is present.

4. The method as in claim 2, further comprising generating an error signal when the indicated condition of the spinning station sensor indicates that no yarn is present and the indicated condition of the travelling service carriage indicates that no yarn is present.

5. The method as in claim 2, further comprising generating an error signal when the indicated condition of the spinning station sensor indicates that no yarn is present and the indicated condition of the travelling service carriage indicates that yarn is present.

6. The method as in claim 1, comprising extending the working range of the work station sensor from the moment the yarn is ejected from a throw-off bobbin of the travelling service carriage to the moment when the automatic travelling service carriage withdraws its yarn monitoring system from the course of the yarn at the spinning station.

7. The method as in claim 1, further comprising extending the working range of the travelling service carriage sensor to overlap at least a portion of the working range of the work station sensor.

8. The method as in claim 1, further comprising extending the working range of the work station sensor to overlap at least a portion of the working range of the travelling service carriage sensor.

* * * * *